US005082255A

United States Patent [19]

Brigante et al.

[11] Patent Number: 5,082,255

[45] Date of Patent: Jan. 21, 1992

[54] SHEET PROCESSING APPARATUS

[75] Inventors: Mary-Jo F. Brigante, North Haven; Joseph W. Guiles, Prospect; James Morabito, Bethel, all of Conn.

[73] Assignee: Pitney Bowes, Inc., Stamford, Conn.

[21] Appl. No.: 627,471

[22] Filed: Dec. 14, 1990

[51] Int. Cl.[5] ..... B42C 1/00

[52] U.S. Cl. ..... 270/45; 270/47; 493/420

[58] Field of Search ..... 270/32, 45, 46, 47, 270/51, 55, 57, 42; 493/419, 420

[56] References Cited

U.S. PATENT DOCUMENTS

| | | | |
|---|---|---|---|
| 3,059,391 | 10/1962 | Volks | 270/45 |
| 3,265,382 | 8/1966 | Sherman | 270/45 |
| 3,416,785 | 12/1968 | Sherman | 270/45 |
| 3,934,867 | 1/1976 | Oeschger | 270/32 |
| 4,496,339 | 1/1985 | Moll | 493/420 |
| 4,834,695 | 5/1989 | Boblit | 493/420 |
| 4,898,570 | 2/1990 | Luperti | 270/45 |
| 4,900,391 | 2/1990 | Mandel | 270/45 |

FOREIGN PATENT DOCUMENTS

| | | | |
|---|---|---|---|
| 242866 | 10/1988 | Japan | 270/32 |

OTHER PUBLICATIONS

Xerox Disclosure Statement, "Folder/Nester"; Robert Hayskar, vol. 8, No. 2; Mar./Apr. 1983.

*Primary Examiner*—Edward K. Look
*Assistant Examiner*—Therese M. Newholm
*Attorney, Agent, or Firm*—Donald P. Walker; David E. Pitchenik; Melvin J. Scolnick

[57] ABSTRACT

Apparatus for processing sheets, comprising: first structure for feeding a nestable sheet having a leading edge downstream in a path of travel; structure for forming a buckle loop in a foldable sheet, the buckle loop forming structure including a stop, the buckle loop forming structure including second structure for feeding the foldable sheet across the path of travel and against the stop to form a buckle loop therein, the buckle loop forming structure including structure for guiding the buckle loop downstream of the leading edge of the nestable sheet and in the path of travel thereof; and structure for assembling the sheets, the assembling structure including third structure for feeding the sheets in the path of travel, the third feeding structure including an elongate drive roller extending transverse to the path of travel, the third feeding structure including an elongate roller extending parallel to the drive roller and defining therebetween an elongate gap, and the assembling structure including structure for opening and closing the gap.

38 Claims, 3 Drawing Sheets

SHEET PROCESSING APPARATUS

This invention is generally concerned with apparatus for processing sheets and more particularly with apparatus for nesting one sheet within another, folded, sheet.

As shown in U.S. Pat. No. 2,736,999 for an Envelope Stuffing Machine, issued Mar. 6, 1956 to F. J. Rouan et al, apparatus has been provided for feeding individual pieces of mailing material, from each of a plurality of hoppers, to an intermittently movable conveyor on which one of the pieces of material is nested within another, pre-folded, piece of material preparatory to stuffing the assembled pieces into an envelope. Thus it is generally known in the art to nest one sheet within a another, folded, sheet preparatory to stuffing the assembled sheets into an envelope.

However, apparatus of the aforesaid type is too slow to be useful in high speed mailpiece assembling applications, wherein eight to fifteen thousand envelopes per hour must be reliably stuffed with assembled materials, including, for example, advertising materials, a remittance slip and a return envelope, for bulk mailing to various customers on a monthly basis. Accordingly:

An object is to provide improved apparatus for processing sheets;

Another object is to provide continuously operable sheet nesting apparatus; and

Yet another object is to provide high speed apparatus for nesting one or more sheets within one or more other, pre-folded, sheets.

SUMMARY OF THE INVENTION

Apparatus for processing sheets, comprising: first means for feeding a nestable sheet having a leading edge downstream in a path of travel; means for forming a buckle loop in a foldable sheet, the buckle loop forming means including a stop, the buckle loop forming means including second means for feeding the foldable sheet across the path of travel and against the stop to form a buckle loop therein, the buckle loop forming means including means for guiding the buckle loop downstream of the leading edge of the nestable sheet and in the path of travel thereof; and means for assembling the sheets, the assembling means including third means for feeding the sheets in the path of travel, the third feeding means including an elongate drive roller extending transverse to the path of travel, the third feeding means including an elongate roller extending parallel to the drive roller and defining therebetween an elongate gap, and the assembling means including means for opening and closing the gap.

DESCRIPTION OF THE PREFERRED EMBODIMENTS

Figure 1:
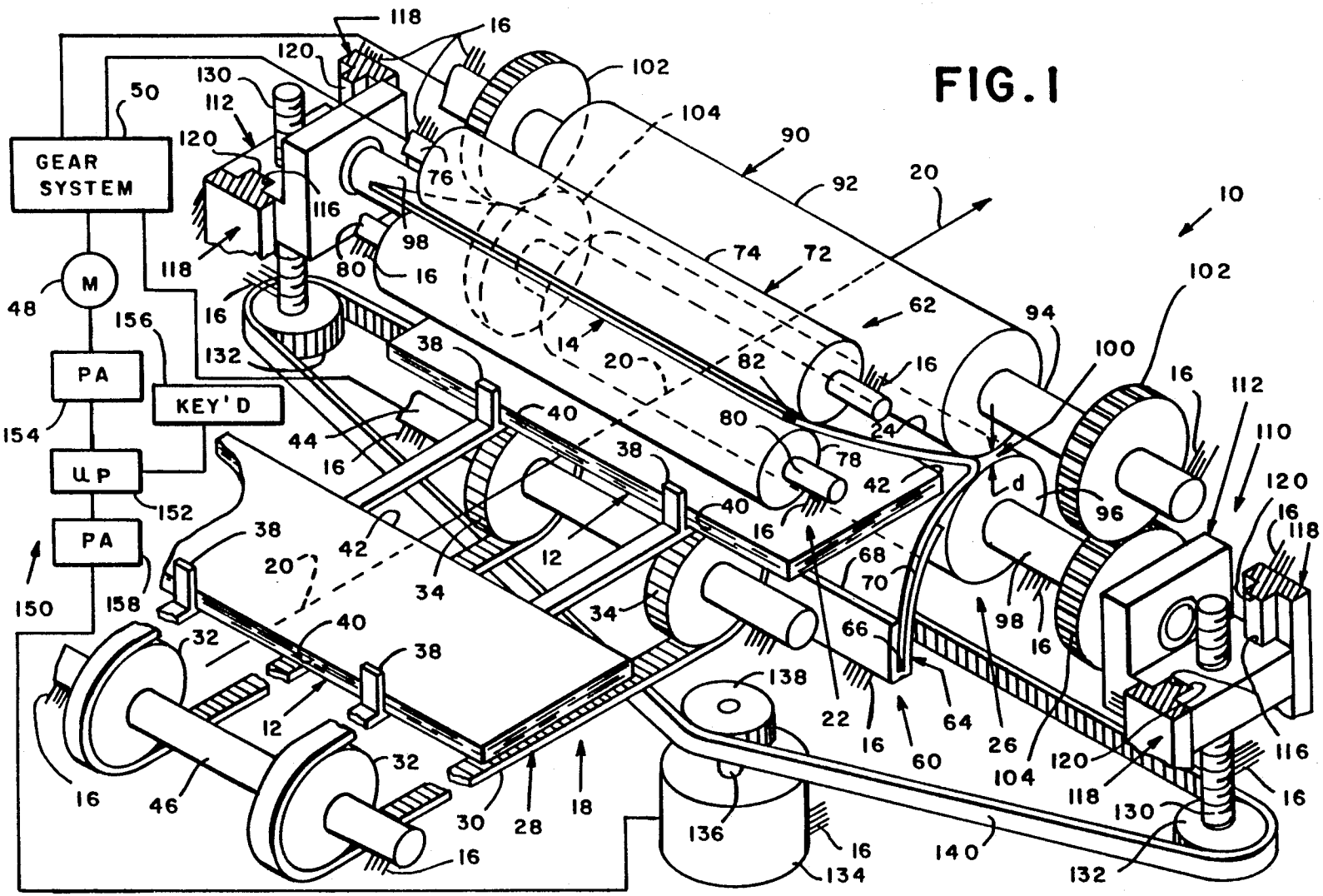
FIG. 1 is a partially schematic, perspective, view of apparatus according to the invention for processing nestable and foldable sheets.

As shown in FIG. 1, according to the invention there is provided sheet processing apparatus 10, and more particularly apparatus 10 for processing a nestable sheet 12 and a foldable sheet 14.

For the purposes of this disclosure, a nestable sheet 12 (FIG. 1) may comprise one or more cut sheets, letters, advertising materials, cards, remittance slips, or envelopes with or without a window formed therein, or the like, whereas a foldable sheet 14 may comprises any one or more of the foregoing types of sheets. Moreover a nestable sheet 12 may comprises a sealed or unsealed envelope, with or without a window formed therein, which has stuffed therein one or more nested or folded, or nestable or foldable, sheets, 12 or 14.

According to the invention, the sheet processing apparatus 10 (FIG. 1) generally includes framework 16 for supporting the various components thereof, including input feeding structure 18 for feeding a nestable sheet 12 downstream in a path of travel 20, buckle loop structure 22 for forming, downstream from the nestable sheet 12, a buckle loop 24 in a foldable sheet 14, and assembling structure 26 for assembling nestable and foldable sheets, 12 and 14.

The input feeding structure 18 (FIG. 1) preferably comprises a belt system 28 including at least one, and preferably a plurality of, such as two, parallel-spaced endless timing belts 30, and a like number of pairs of upstream and downstream timing pulley gears 32 and 34. Each of the belts 30 is conventionally endlessly looped about and disposed in meshing engagement with a pair of the pulley gears, 32 and 34. Preferably, each of the belts 30 includes a plurality of sheet feeding members 38, extending outwardly from the belt at equally spaced intervals longitudinally of the length thereof, for engaging and urging the sheets 12 downstream in the path of travel 20. Thus each of the nestable sheets 12 has an upstream, or trailing, edge 40, and has a downstream, or leading, edge 42, in the path of travel 20. Assuming the provision of a plurality of belts 30, the sheet feeding members 36 of each belt 30 are aligned with one another so as to form a plurality of rows of members 36, at equally spaced intervals along the length of the belts 30, which extend perpendicularly-transverse to the path of travel 20. For moving each belt 30, the input feeding structure 18 also includes a drive shaft 44 which is conventionally rotatably connected to the framework 16. And the downstream timing pulley gears 34 are conventionally fixedly connected to the drive shaft 44 for rotation therewith. In addition, the feeding structure 18 includes an idler shaft 46, which is conventionally connected to the framework 16. And the upstream timing pulley gears 32 are suitably connected for rotation 40 the idler shaft 46. Moreover, the feeding structure 18 includes a conventional d.c. motor 48 for driving the drive shaft 44, and includes a suitable gear system 50 for interfacing the d.c. motor 50 with the drive shaft 44. As thus constructed and arranged, the input feeding structure 18 is adapted for receiving nestable sheets 12 which are conventionally successively fed thereto, and successively feeding the sheets 12 at equally spaced intervals in the path of travel 20, downstream to the assembling structure 26.

The buckle loop forming structure 22 (FIG. 1) generally includes buckle chute structure 60 and foldable sheet feeding structure 62, which are conventionally connected to the framework 16 downstream from the nestable sheet feeding structure 18, on opposite sides of the path of travel 20. The buckle chute structure 60 comprises an elongate, channel-like, member 64 which is preferably disposed beneath the path of travel 20 and extends perpendicularly-transverse thereto. The member 64 includes an elongate base wall, or stop, 66, and includes upstream and a downstream guide walls, 68 and 70. The guide walls, 68 and 70, extend from the base wall 66 towards the path of travel 20. And, preferably, the downstream guide wall 70 curvedly-extends progressively towards, and downstream alongside of, the path of travel 20. The foldable sheet feeding structure 62 comprises a pair of elongate, parallel-spaced, rollers 72 which is preferably disposed above the path of travel 20. The rollers 72 include an elongate drive roller 74, which is conventionally rotatably connected to the framework 16 by means of a drive shaft 76 so as to extend perpendicularly-transverse to the path of travel 20, and an elongate idler roller 78, which is conventionally rotatably connected to the framework 16 by means of an idler shaft 80 so as to extend parallel to the drive roller 78 and define therebetween an elongate nip 82. The nip 82 extends transverse to the path of travel 20 and is oriented relative to the buckle chute structure 60 for feeding each foldable sheet 14 across the path of travel 20, and against the base wall 66 to form the buckle loop 24 in the sheet 14 in a manner such that the buckle loop 24 extends downstream against the downstream guide wall 68 and is progressively guided thereagainst to loop into the path of travel and downstream to the assembling structure 26. In addition, the buckle loop structure 22 includes the d.c. motor 48 for driving the drive shaft 76, and includes the gear system 50 for interfacing the d.c. motor 48 with the drive shaft 76. Moreover, the gear system 50 is conventionally constructed an arranged for driving the sheet feeding structures, 18 and 62, in timed relationship with one another for causing each foldable sheet 14 to loop downstream in the path of travel 20 in advance of the leading edge 42 of each nestable sheet 12 fed to the assembling structure 26, in a manner such that each of the nestable sheets 12 is fed downstream within the buckle loop 24 of a foldable sheet 14. As thus constructed and arranged, the buckle loop structure 22 is adapted for receiving foldable sheets 14, which are conventionally successively fed thereto, and is adapted to successively feed the sheets 14 for forming successive buckle loops 24 extending downstream in the path of travel 20 to the assembling structure 26.

The assembling structure 26 (FIG. 1) comprises a pair of elongate parallel-spaced rollers 90, including an elongate drive roller 92, which is conventionally connected to the framework 16 by means of a drive shaft 94 so as to extend perpendicularly-transverse to the path of travel 20, and an elongate driven roller 96, which is rotatably connected to the framework 16 by means of an driven roller shaft 98 so as to extend parallel to the drive roller 92 and define therewith an elongate gap 100 having a width dimension "d". Further, the assembling structure 26 includes a pair of parallel-spaced drive gears 102 which are conventionally fixedly attached to the opposite ends of the drive shaft 90, and includes a pair of parallel-spaced driven gears 104 which are conventionally fixedly attached to the opposite ends of the driven roller shaft 98 and disposed in meshing engagement with associated drive gears 102. Preferably, the drive and driven gears, 102 and 104, are spur gears which are modified to ensure continuous meshing engagement therebetween when the driven gears 104 are moved toward and away from the drive gears 102 any selected distance of from substantially zero fifty thousandths of an inch. In addition, the assembling structure 26 includes the d.c. motor 48 for driving the drive shaft 94, and includes the gear system 50 for interfacing the d.c. motor 48 with the drive shaft 76. Moreover, the gear system 50 is conventionally constructed and arranged for driving the drive shaft 94 in timed relationship with the sheet feeding structures, 18 and 62.

In addition, the assembling structure 26 (FIG. 1) includes structure 110 for changing the width dimension "d" of the gap 100 for initially engaging and feeding the foldable sheet 14 for folding purpose, and then engaging and feeding the resulting folded sheet 14 with the nestable sheet 12 nested therein, downstream in the path of travel 20. To that end, the gap width changing structure 110 includes a pair of opposed, parallel spaced, generally L-shaped, slide blocks 112, to which the opposite ends 114 of the driven shaft 98 are conventionally journaled for rotation. Each of the blocks 112 includes a pair of opposed, parallel spaced, key ways 116, which are vertically formed therein. And the gap changing structure 110 includes a pair of parallel-spaced, opposed, key pads 118, associated with each of the slide blocks 112, which are conventionally connected to the framework 16. Each of the key pads 116 includes a vertically oriented key 120. And the opposed key ways 114 of each slide block 112 are slidably connected to the keys 120 of the opposed key pads 118 associated therewith for vertical movement, whereby the driven shaft 98, and thus the driven roller 96, is rotatably connected to the framework 16 and vertically slidably movable toward and away from the drive roller 92 for changing the width dimension "d" of the gap 100. In addition, the gap width changing structure 110 includes a pair of parallel-spaced, vertically oriented, jack screws 130, which are conventionally rotatably connected to the framework 16 and threadably connected to the opposed slide blocks 112. Further, a pair of timing pulley gears 132, which are fixedly connected to the respective jack screws 130 on a one for one basis, are provided for rotating the jack screws 130 in timed relationship with one another, to raise and lower the slide blocks 112, and thus the opposite ends of the driven shaft 98, in unison with one another. Moreover, the gap width changing structure 110 includes a d.c. motor 134 including an output shaft 136 having fixedly connected thereto an output timing pulley gear 138. And the gap width changing structure 110 includes a timing belt 140 which is endlessly looped about the pulley gears, 132 and 138, for transmitting rotational motion of the d.c. motor 134 to the jack screws 130 for vertically moving the slide blocks 112, and thus the driven shaft 98 and driven roller 92.

Figure 2:
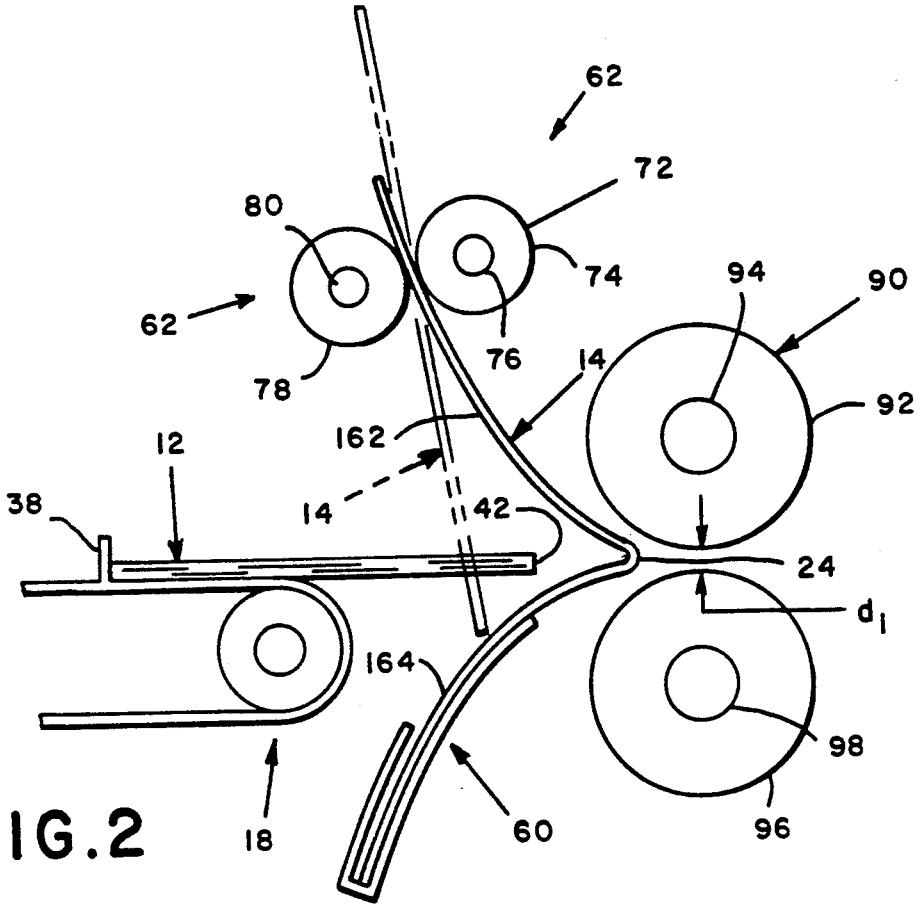
FIG. 2 is a schematic elevation of the apparatus of FIG. 1, showing a foldable sheet being fed between separated assembling rollers.
Figure 3:
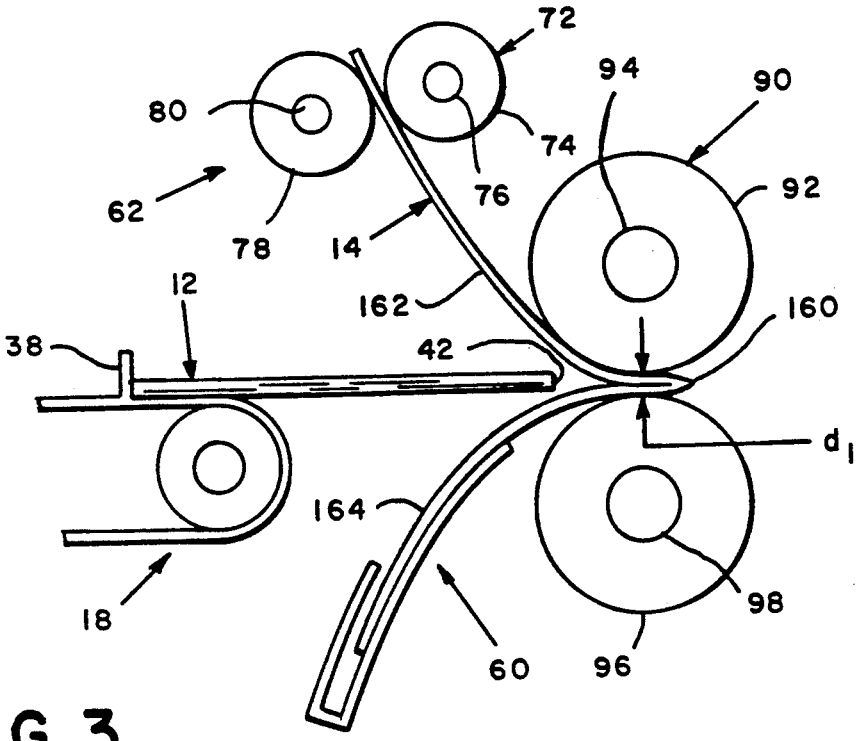
FIG. 3 is a schematic view, similar to FIG. 2, showing the assembling rollers thereof engaging and folding the foldable sheet.
Figure 4:
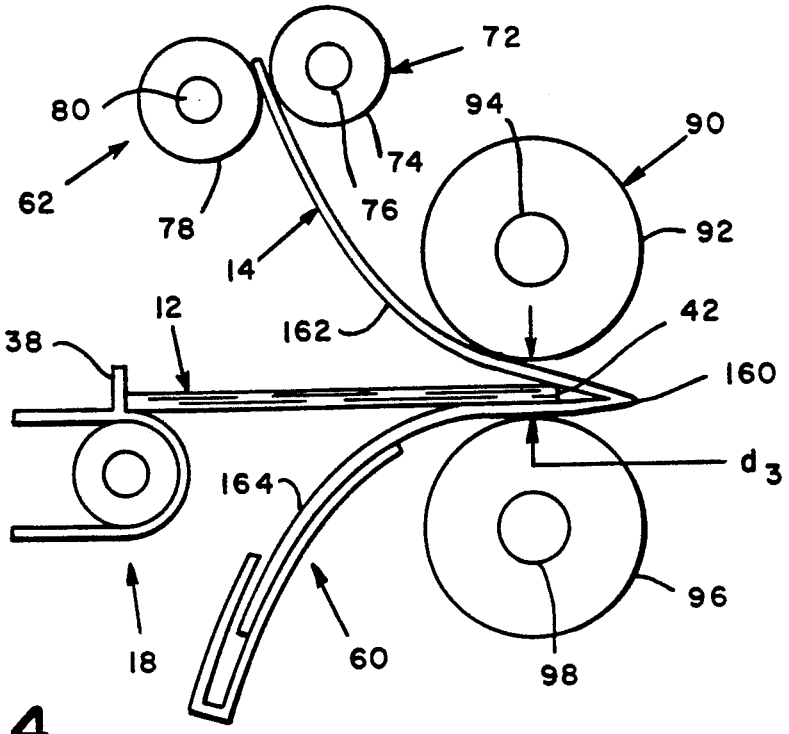
FIG. 4 is a schematic view, similar to FIG. 3, showing the assembling rollers thereof separated, and a nestable sheet being nested within the folded sheet for assembly thereof.
Figure 5:
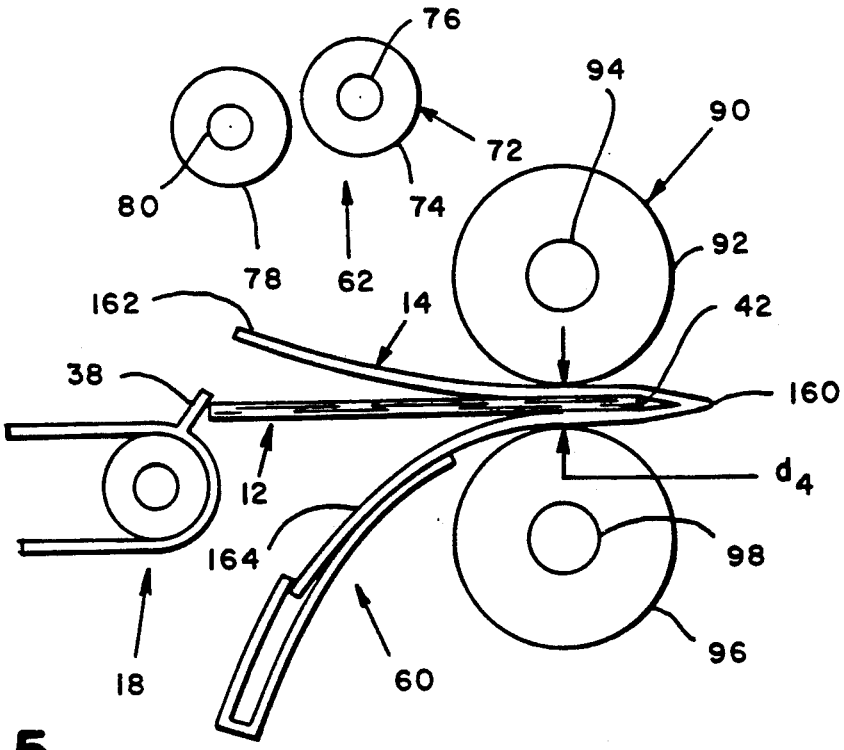
FIG. 5 is a schematic view, similar to FIG. 4, showing the assembling rollers thereof engaging and feeding the assembly of sheets.

For controlling the motor 48 (FIG. 1) and thus rotation of the drive shafts 44, 76 and 94 in timed relationship with one another, the sheet processing apparatus 10 includes conventional computer structure 150, including a suitable microprocessor 152 and a power amplifier 154 for interfacing the microprocessor 152 with the motor 48, and including a conventional keyboard 156 which is suitably connected to the microprocessor 152 to permit operator input thereto for energizing and deenergizing the motor 48. Moreover, the microprocessor 152 is preferably conventionally programmed for driving the motor 48 at a plurality of selected speeds in response to conventional operator input. In addition, for controlling the motor 134 and thus adjustment of the gap 100 in timed relationship with successively feeding a given foldable sheet 14 followed by a nestable sheet 12 downstream in the path of travel 20, the sheet processing apparatus 10 includes a suitable power amplifier 158 for interfacing the microprocessor 152 with the motor 134. And the microprocessor 152 is conventionally programmed for initially opening the gap 100 to a first predetermined width dimension "$d_1$" (FIG. 2) for receiving therein the buckle loop 24 of the given foldable sheet 14, then closing the gap 100 to a second predetermined width dimension "$d_2$" (FIG. 3) for engaging and feeding the buckle loop 24 to form a fold edge 160 in the given sheet 14, whereby the resulting folded sheet 14 has formed therein a sheet portion 162 extending from the fold edge 160 toward the buckle loop feeding structure 62 and another sheet portion 164 extending from the gap 100 toward the buckle chute structure 60, then re-opening the fold edge 160 to a third predetermined width dimension "$d_3$" (FIG. 4) for receiving within the gap 100 a given nestable sheet 12 which is fed downstream between the folded sheet portions, 162 and 164, whereby the given sheet 12 is nested within the folded sheet 14, and then re-closing the gap 100 to a fourth predetermined width dimension "$d_4$" (FIG. 5) for engaging and feeding an assembly 166 of the given nested and folded sheets, 12 and 14, downstream in the path of travel 20 from the sheet processing apparatus 10. Moreover, the microprocessor 152 is preferably conventionally programmed to receive conventional operator input which corresponds to the specification of the aforesaid first, second, third and fourth predetermined dimensions "$d_1$", "$d_2$", "$d_3$" and "$d_4$", within the range of from substantially zero to fifty thousandths of an inch, to permit the sheet processing apparatus 10 to be used for assembling a variety of nestable and foldable sheets, 12 and 14, of various weights and dimensions.

In accordance with the objects of the invention there has been disclosed improved sheet processing apparatus for nesting one or more sheets within one or more other, pre-folded, sheets.

What is claimed is:

1. Apparatus for processing sheets, comprising:

a. first means for feeding a nestable sheet having a leading edge downstream in a path of travel;

b. means for forming a buckle loop in a foldable sheet, the buckle loop forming means including a stop, the buckle loop forming means including second means for feeding the foldable sheet across the path of travel and against the stop to form a buckle loop therein, the buckle loop forming means including means for guiding the buckle loop downstream of the leading edge of the nestable sheet and in the path of travel thereof; and c. means for assembling the sheets, the assembling means including third means for feeding the sheets in the path of travel, the third feeding means including an elongate drive roller extending transverse to the path of travel, the third feeding means including an elongate roller extending parallel to the drive roller and defining therebetween an elongate gap, the assembling means including means for opening and closing the gap, and the means for opening and closing the gap including means for opening the gap for receiving the buckle loop.

2. The apparatus according to claim 5, wherein the first feeding means includes a timing belt having a member extending outwardly therefrom for engaging and feeding the nestable sheet.

3. The apparatus according to claim 5, wherein the buckle loop forming means includes a buckle chute laterally spaced from the path of travel, the buckle chute including the stop and the means for guiding the buckle loop, and the means for guiding the buckle loop including a guide wall curvedly-extending downstream from the stop and toward the path of travel.

4. The apparatus according to claim 5, wherein the roller extending parallel to the drive roller is a driven roller, the sheet assembling means including a drive gear connected to the drive roller and a driven gear connected to the driven roller, and the drive and driven gears disposed in meshing engagement when the gap is open and when the gap is closed.

5. The apparatus according to claim 1 including computer means for controlling the apparatus.

6. Apparatus for processing sheets, comprising:

a. first means for feeding a nestable sheet having a leading edge downstream in a path of travel;

b. means for forming a buckle loop in a foldable sheet, the buckle loop forming means including a stop, the buckle loop forming means including second means for feeding the foldable sheet across the path of travel and against the stop to form a buckle loop therein, the buckle loop forming means including means for guiding the buckle loop downstream of the leading edge of the nestable sheet and in the path of travel thereof; and c. means for assembling the sheets, the assembling means including third means for feeding the sheets in the path of travel, the third feeding means including an elongate drive roller extending transverse to the path of travel, the third feeding means including an elongate roller extending parallel to the drive roller and defining therebetween an elongate gap, the assembling means including means for opening and closing the gap, and the means for opening and closing the gap including means for closing the gap for engaging and feeding the buckle loop to form a fold edge therein.

7. The apparatus according to claim 6, wherein the first feeding means includes a timing belt having a member extending outwardly therefrom for engaging and feeding the nestable sheet.

8. The apparatus according to claim 6, wherein the buckle loop forming means includes a buckle chute laterally spaced from the path of travel, the buckle chute including the stop and the means for guiding the buckle loop, and the means for guiding the buckle loop including a guide wall curvedly-extending downstream from the stop and toward the path of travel.

9. The apparatus according to claim 6, wherein the roller extending parallel to the drive roller is a driven roller, the sheet assembling means including a drive gear connected to the drive roller and a driven gear connected to the driven roller, and the drive and driven gears disposed in meshing engagement when the gap is open and when the gap is closed.

10. The apparatus according to claim 6 including computer means for controlling the apparatus.

11. Apparatus for processing sheets, comprising:

a. first means for feeding a nestable sheet having a leading edge downstream in a path of travel;

b. means for forming a buckle loop in a foldable sheet, the buckle loop forming means including a stop, the buckle loop forming means including second means for feeding the foldable sheet across the path of travel and against the stop to form a buckle loop therein, the buckle loop forming means including means for guiding the buckle loop downstream of the leading edge of the nestable sheet and in the path of travel thereof; and c. means for assembling the sheets, the assembling means including third means for feeding the sheets in the path of travel, the third feeding means including an elongate drive roller extending transverse to the path of travel, the third feeding means including an elongate roller extending parallel to the drive roller and defining therebetween an elongate gap, the assembling means including means for opening and closing the gap, and the means for opening and closing the gap including means for opening the gap for receiving therein the nestable sheet within a folded buckle loop.

12. The apparatus according to claim 11, wherein the first feeding means includes a timing belt having a member extending outwardly therefrom for engaging and feeding the nestable sheet.

13. The apparatus according to claim 11, wherein the buckle loop forming means includes a buckle chute laterally spaced from the path of travel, the buckle chute including the stop and the means for guiding the buckle loop, and the means for guiding the buckle loop including a guide wall curvedly-extending downstream from the stop and toward the path of travel.

14. The apparatus according to claim 11, wherein the roller extending parallel to the drive roller is a driven roller, the sheet assembling means including a drive gear connected to the drive roller and a driven gear connected to the driven roller, and the drive and driven gears disposed in meshing engagement when the gap is open and when the gap is closed.

15. The apparatus according to claim 11, including computer means for controlling the apparatus.

16. Apparatus for processing sheets, comprising:

a. first means for feeding a nestable sheet having a leading edge downstream in a path of travel;

b. means for forming a buckle loop in a foldable sheet, the buckle loop forming means including a stop, the buckle loop forming means including second means for feeding the foldable sheet across the path of travel and against the stop to form a buckle loop therein, the buckle loop forming means including means for guiding the buckle loop downstream of the leading edge of the nestable sheet and in the path of travel thereof; and c. means for assembling the sheets, the assembling means including third means for feeding the sheets in the path of travel, the third feeding means including an elongate drive roller extending transverse to the path of travel, the third feeding means including an elongate roller extending parallel to the drive roller and defining therebetween and elongate gap, the assembling means including means for opening and closing the gap, and the means for opening and closing the gap including means for closing the gap for engaging and feeding an assembly of the nestable and foldable sheets.

17. The apparatus according to claim 16, wherein the first feeding means includes a timing belt having a member extending outwardly therefrom for engaging and feeding the nestable sheet.

18. The apparatus according to claim 16, wherein the buckle loop forming means includes a buckle chute laterally spaced from the path of travel, the buckle chute including the stop and the means for guiding the buckle loop, and the means for guiding the buckle loop including a guide wall curvedly-extending downstream from the stop and toward the path of travel.

19. The apparatus according to claim 16, wherein the roller extending parallel to the drive roller is a driven roller, the sheet assembling means including a drive gear connected to the drive roller and a driven gear connected to the driven roller, and the drive and driven gears disposed in meshing engagement when the gap is open and when the gap is closed.

20. The apparatus according to claim 16, including computer means for controlling the apparatus.

21. Apparatus for processing sheets, comprising:

a. means for assembling a nestable sheet and foldable sheet, the assembling means including first means for feeding the sheets downstream in a path of travel, the first feeding means including a first pair of elongate parallel-spaced rollers extending transverse to the path of travel and defining therebetween an elongate gap having a width dimension;

b. means for forming a buckle loop in the foldable sheet, the buckle loop forming means including a stop, the buckle loop forming means including second means for feeding the foldable sheet, the second feeding means including a second pair of elongate parallel-spaced rollers extending transverse to the path of travel for feeding the foldable sheet across the path of travel and against the stop to form a buckle loop therein, the buckle loop forming means including means for guiding the buckle loop downstream into the gap between the first rollers;

c. third means for feeding the nestable sheet downstream in the path of travel within the buckle loop; and d. the assembling means including means for changing the width dimension of the gap in timed relationship with feeding a sheet.

22. The apparatus according to claim 21, wherein the third feeding means includes a timing belt having a member extending outwardly therefrom for engaging and feeding the nestable sheet.

23. The apparatus according to claim 21, wherein the buckle loop forming means includes a buckle chute laterally spaced from the path of travel, the buckle chute including the stop and the means for guiding the buckle loop, and the means for guiding the buckle loop including a guide wall curvedly-extending downstream from the stop and toward the path of travel.

24. The apparatus according to claim 21, wherein the roller extending parallel to the drive roller is a driven roller, the means for assembling the sheets including a drive gear connected to the drive roller and a driven gear connected to the driven roller, and the drive and driven gears disposed in meshing engagement when the gap is changed.

25. The apparatus according to claim 21, wherein the means for changing the gap includes means for opening the gap for receiving the buckle loop.

26. The apparatus according to claim 21, wherein the means for changing the gap includes means closing the gap for engaging and feeding the buckle loop to form a fold edge therein.

27. The apparatus according to claim 21, wherein the means for changing the gap includes means for opening the gap to receiving therein the nestable sheet within a folded buckle loop.

28. The apparatus according to claim 21, wherein the means for changing the gap includes means for closing the gap for engaging and feeding an assembly of the nestable and foldable sheets.

29. The apparatus according to claim 21 including computer means for controlling the apparatus.

30. Apparatus for processing sheets, comprising:

a. means for assembling a nestable sheet and a foldable sheet, the assembling means including first means for feeding the sheets downstream in a path of travel, the first feeding means including a first elongate drive roller extending transverse to the path of travel, the first feeding means including a first elongate driven roller extending parallel to the first drive roller and defining therebetween an elongate gap having a changeable width dimension;

b. means for forming a buckle loop in the foldable sheet, the buckle loop forming means including a stop laterally spaced from the path of travel upstream of the assembling means, the buckle loop forming means including second means for feeding the foldable sheet, the second feeding means including a second elongate drive roller extending transverse to the path of travel, the second feeding means including a second idler roller extending parallel to the second drive roller, the second rollers laterally spaced from the path of travel for feeding the foldable sheet across the path of travel and against the stop to form a buckle loop therein, the buckle loop forming means including means for guiding the buckle loop downstream into the gap between the first rollers;

c. third means for feeding the nestable sheet downstream in the path of travel and into the gap within the buckle loop; and d. means for changing the width dimension of the gap in timed relationship with feeding a sheet.

31. The apparatus according to claim 30, wherein the third feeding means includes a timing belt having a member extending outwardly therefrom for engaging and feeding the nestable sheet.

32. The apparatus according to claim 30, wherein the buckle loop forming means includes a buckle chute laterally spaced from the path of travel, the buckle chute including the stop and the means for guiding the buckle loop, and the means for guiding the buckle loop including a guide wall curvedly-extending downstream from the stop and toward the path of travel.

33. The apparatus according to claim 30, wherein the roller extending parallel to the drive roller is a driven roller, the sheet assembling means including a drive gear connected to the drive roller and a driven gear connected to the driven roller, and the drive and driven gears disposed in meshing engagement with one another.

34. The apparatus according to claim 30, wherein the changing means includes means for opening the gap for receiving the buckle loop.

35. The apparatus according to claim 30, wherein the changing means includes means for closing the gap for engaging and feeding the buckle loop to form a fold edge therein.

36. The apparatus according to claim 30, wherein the changing means includes means for opening the gap for receiving therein the nestable sheet within a folded buckle loop.

37. The apparatus according to claim 30, wherein the changing means includes means for closing the gap for engaging and feeding an assembly of the nestable and foldable sheets.

38. The apparatus according to claim 30 including computer means for controlling the apparatus.

* * * * *